United States Patent [19]

Glidden, Jr.

[11] Patent Number: 4,964,619

[45] Date of Patent: Oct. 23, 1990

[54] FENCE FRAME

[76] Inventor: Allen L. Glidden, Jr., P.O. Box 444, Bridge City, Tex. 77611

[21] Appl. No.: 452,797

[22] Filed: Dec. 18, 1989

[51] Int. Cl.[5] ..... E04H 17/06

[52] U.S. Cl. ..... 256/32; 52/102; 47/33

[58] Field of Search ..... 52/102, 584; 47/33; 404/7, 8; 256/32, 33, 35

[56] References Cited

U.S. PATENT DOCUMENTS

| | | | |
|---|---|---|---|
| 3,384,351 | 5/1968 | Turner, Jr. | 256/32 |
| 3,515,373 | 6/1970 | Abbe | 256/32 |
| 3,713,624 | 1/1973 | Niemann | 47/33 X |
| 3,806,096 | 4/1974 | Eccleston | 47/33 X |
| 4,349,989 | 9/1982 | Snider, Jr. | 47/33 X |
| 4,548,388 | 10/1985 | Cobler | 256/32 |
| 4,907,783 | 3/1990 | Fisk et al. | 256/32 |

*Primary Examiner*—David A. Scherbel
*Assistant Examiner*—Michele A. Van Patten

[57] ABSTRACT

An improved vegetation barrier installed along the bottom edge of a chain-link or similar type fence, in a manner that will beautify a lawn and reduce grooming time. The fence frame is a system of molded vegetation barriers that are installed easily with few or no tools. The fence frame consist of elongated molded vegetation barriers, preferably plastic, having two basic cross-sectional shapes. One has a basically rectangular shape (12), and the other has basically an L-shaped cross-section (10). Both types are longitudinally grooved (40) (38) to receive a series of upper spring clip brackets (20) and corresponding base brackets (18) (22) that secure the vegetation barriers to the fence bottom and the underlying ground. Both types, in addition, are longitudinally grooved (42) to receive uniquely designed splice covers (24) (26), and post adapters (14) (30) (32) that are snapped into position without the use of tools. The basic molding styles may be used singularly on one side of a fence or in combination using like or unlike styles on opposite sides. The molded barriers are of sufficient rigidity to protect the fence from the impact of mowing and trimming devices, and at the same time, serve as a guide for these devices. In a preferred form of the invention, the barriers are molded to give the appearance of a border of brick (34), stone, or a variety of decorative patterns.

13 Claims, 3 Drawing Sheets

FENCE FRAME

BACKGROUND

1. Field of Invention

This invention relates to the elimination of undesirable vegetation directly beneath and adjacent to a chain-link or similar type fence, and at the same time serves as a decorative yard border.

2. Description of Prior Art

The task of grooming a yard that is bordered by or contains a chain-link fence has burdened the average home owner since the first fence was installed. Attempts at solving the problem all have the same basic idea. The idea is to remove the space that cultivates unwanted vegetation by covering the space with a vegetation barrier. Although several barriers have been invented, none have completely solved the problem in a way to satisfy the criteria of the average home owner. For example, A. W. Turner, Jr. U.S. Pat. No. 3,384,351 5/1968, titled GRASS GUARD for FENCE, includes a barrier in rolls along with cover plates to seal the ends. This barrier, however, is primarily designed, to be installed before securing the fence fabric to the fence post. This would be impossible on an existing fence. Another example is the barrier in D. M. Abbe U.S. Pat. No. 3,515,373, 6/1970, titled FENCE TRIM GUARD. This barrier is composed of two axially aligned, telescopically interlocking barriers designed to cover the ground beneath the fence. These barriers are secured to the ground by outwardly extended, perforated lateral flange portions beneath the ground. Again, this invention presents difficulties in installation. Another barrier, the FENCE GUARD of Fred T. Niemann, U.S. Pat. No. 3,713,624, 1/1973, is a barrier that is L-shaped in cross-section and is placed against the fence bottom on either one side or both sides. However, this barrier lacks an adequate means of stability and suffers from some design flaws in its interlocking means. Basically, the interlocking fingers which are at the same elevation on back to back mounted barriers would make the two barriers on different planes when they interlock. This would raise one barrier off the ground and defeat its purpose. Also, the barriers lock to each other and not necessarily to the fence. In addition, there is no lock-in-place mechanism when only one barrier is installed on a singular side. Another barrier, FENCE TRIM AND VEGETATION BARRIER, John R. Eccleston U.S. Pat. No. 3,806,096, 4/1974, includes an elongated shell which telescopically receives a core member positioned beneath the fence and shell. The shell has longitudinal slots to receive adjacent post. This barrier is rather complicated and would be very difficult to install under an existing fence. Still another barrier is described in Dean Snider, Jr. U.S. Pat. No. 4,349,989, titled FENCE GUARD, 9/1982. This barrier is positioned beneath the fence and between the post. This barrier also has a swival joint for fence corners at angles other than 90 degrees. However, such a swival joint must be attached to the post by access through a centrally located aperture. This is impossible on an existing fence with the fence fabric attached to the posts. Many of the vegetation barriers of prior art require installation before the fence fabric can be attached to the posts. Also, many of the vegetation barriers of prior art do not consider the fact that most fences are tangent, either partially or continually, to the ground beneath the fence fabric. This tangent condition thereby makes it impossible to install a barrier that must be placed under an existing fence.

OBJECTS AND ADVANTAGES

Accordingly, it is the object of the present invention to include some advantages of previous vegetation barriers and to provide a much improved barrier for new or existing fence lines. Several objects and advantages of the present invention are:

(a) to provide a vegetation barrier that can be installed rapidly, by the average person, using few or no tools.

(b) to provide a vegetation barrier that is more securely attached to the fence and ground. This is accomplished by using a series of uniquely designed snap-on spring clips and base brackets. When these corresponding external clips and brackets are installed they create bilateral inward pressures that hold the barriers to the fence and ground in a stationary position.

(c) to provide a vegetation barrier of sufficient rigidity as to realign existing irregular fence bottoms damaged from the impact of mowing devices.

(d) to provide a vegetation barrier that serves as a guard between the monofilament line of a rotary grass trimmer and the fence fabric.

(e) to provide a vegetation barrier that serves as a shield between a lawnmower and the fence fabric, so as to prevent wheels and guards of a lawnmower from snaring the fence fabric.

(f) to provide a vegetation barrier that gives continuous coverage of the ground beneath the fence when sections are adjoined, either abutted or with a post between. This is accomplished by using a variety uniquely designed snap-on splice covers and post covers.

(g) to provide a vegetation barrier of a material that can be molded into various decorative designs and patterns, such as brick, stone, pebble, etc., thereby creating an attractive yard border.

Further objects and advantages of the present invention will become apparent from a consideration of the drawings and the following description of them.

DRAWING FIGURES

FIG. 1 is an overall view of the invention of the present, showing most of the preferred embodiments, and giving a perspective of its location in relation to the fence.

FIG. 2 is a sectional view, generally along section 2—2 of FIG. 1. Two type-L fence frames are drawn in an installed position against the fence. The top spring clip and base bracket are shown above and below an installed position for clarity.

REFERENCE NUMERALS IN DRAWINGS

Figure 1:
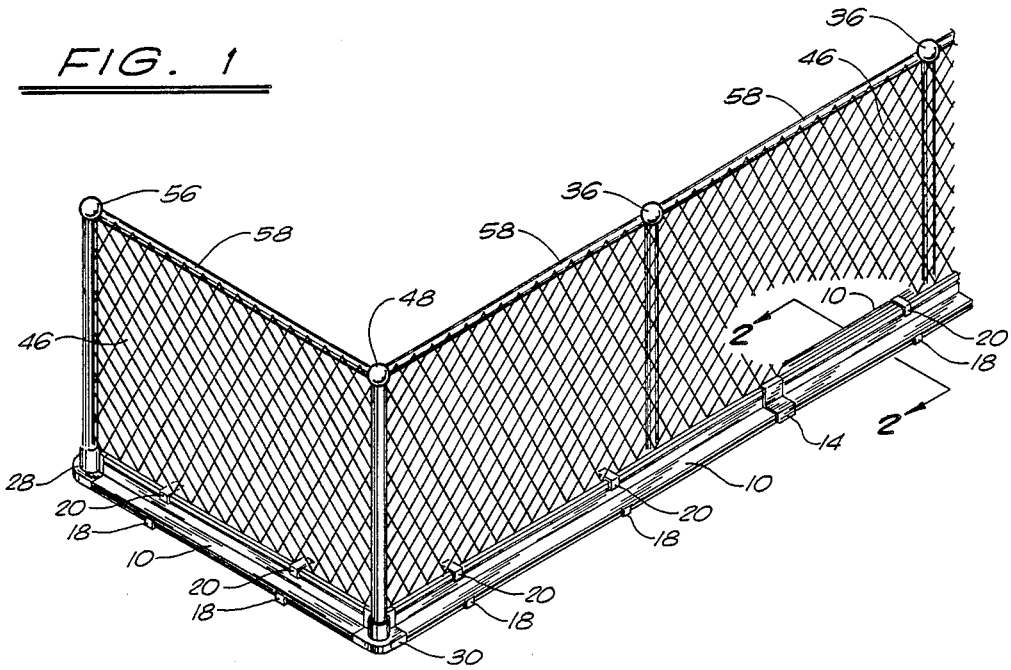

10 type-L fence frame molding
12 type-R fence frame molding
14 type-L abutted splice cover
16 fence post aperture
18 type-LL base bracket
20 top spring clip bracket
22 type-LR base bracket
24 type-R abutted splice cover
26 type-L post splice cover 28 gate post cover
30 outside corner post cover
32 inside corner post cover
34 type-L brick pattern molding
36 straight run fence post
38 base longitudinal V-groove
40 upper semicircular longitudinal groove
42 upper rectangular longitudinal groove
44 top locking tab on splice cover
46 fence fabric
48 corner post
50 base bracket holddown tab
52 molded ground spikes
54 overlapping gate post shields
56 gate post
58 top rail
60 fence base wire
62 spring clip locking tab
64 type-L splice cover bottom locking tab
66 type-R splice cover bottom locking tab

DESCRIPTIONS-FIGS. 1 to 9

Referring to FIG. 1 of the drawings, in a preferred embodiment of the invention, type-L fence frames are attached to the base of a chain-link fence and are illustrated by numeral 10. Type-L fence frames are of a rigid molded, preferably plastic, material of predetermined lengths, normally greater than the span between two corresponding post. Type-L frames are basically L-shaped in cross-section. Each frame is abutted to an adjoining frame, parallel to the fence fabric (46), and tangent to the underlying ground along the fence line. The abutment of two frames is capped by a type-L splice cover (14) to prevent vegetation from growing at the point of abutment and to give the system a look of continuity. The frames are securely attached and stabilized to the base of the fence by using a series of base brackets (18) and corresponding top spring clip brackets (20). The clips are of a width narrow enough to transverse through the diamond shaped apertures formed by the weave of the fence fabric. The clips are of a length equal to the two back-to-back frames plus the fence fabric, in cross-section. The base brackets slip under the fence and rest against the underlying ground. The base brackets are of a width comparable to the top clips and have a length equal to the outside to outside dimension of two back to back frames. The frames are trimmed, if necessary, to correspond with the end of a fence line or gate post (56). The corners are finished with outside post covers (30) and inside post cover (32) (shown FIG. 7).

Figure 2:
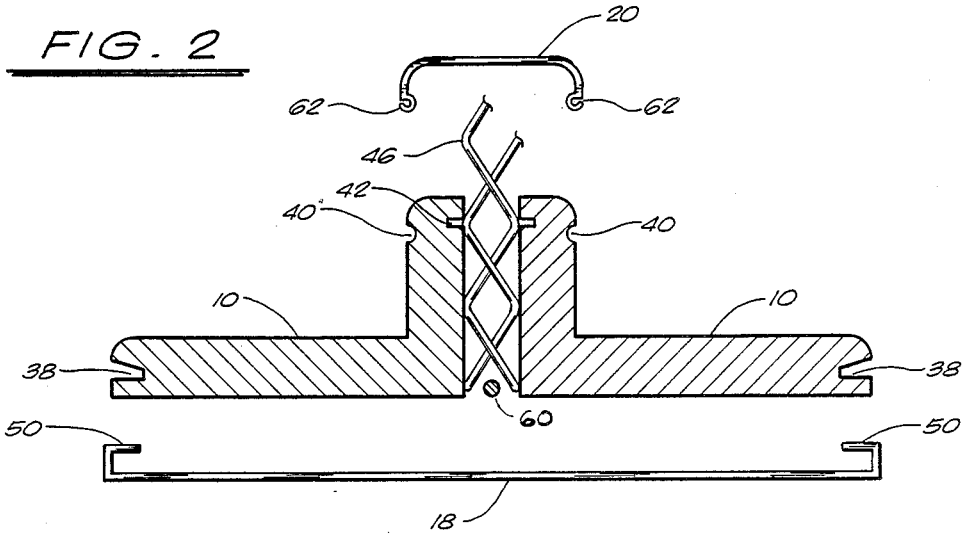

Referring now to FIG. 2, in a cross-sectional view of a fence line, the position of two type-L frames (10) is illustrated showing them in an installed back-to-back arrangement against the fence fabric (46). A base bracket (18) is drawn below the frames to better illustrate the holddown tabs (50) and the corresponding V-groove (38) in which the tabs lock. A top spring clip bracket (20) is drawn above the frames to better illustrate the semicircular longitudinal groove (40) and the locking tabs (62) that snap into the grooves. Once installed, these top clips hold the frames in a clamped, stationary position against the fence and ground.

Figure 3:
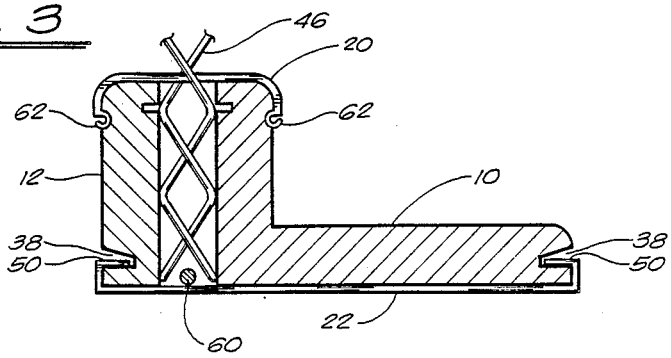
FIG. 3 is a sectional view showing a type-L and a type-R fence frame in an installed position to illustrate how the top clips and base brackets correspond with the longitudinal grooves of the respective frames, holding them stationary to the fence and ground.

Referring to FIG. 3, in a cross-sectional view of a fence line, the position of a type-L frame (10) in conjunction with a type-R frame (12) is illustrated. Type-R frames are basically rectangular in cross-section. A type-LR base bracket (22) is flush with the frame bottoms and under the fence base wire (60). Base bracket holddown tabs (50) are in corresponding longitudinal V-grooves (38). The top spring clip (20) is illustrated installed flush with the top of the frames, and with locking tabs (62) locked into corresponding longitudinal grooves (40).

Figure 4:
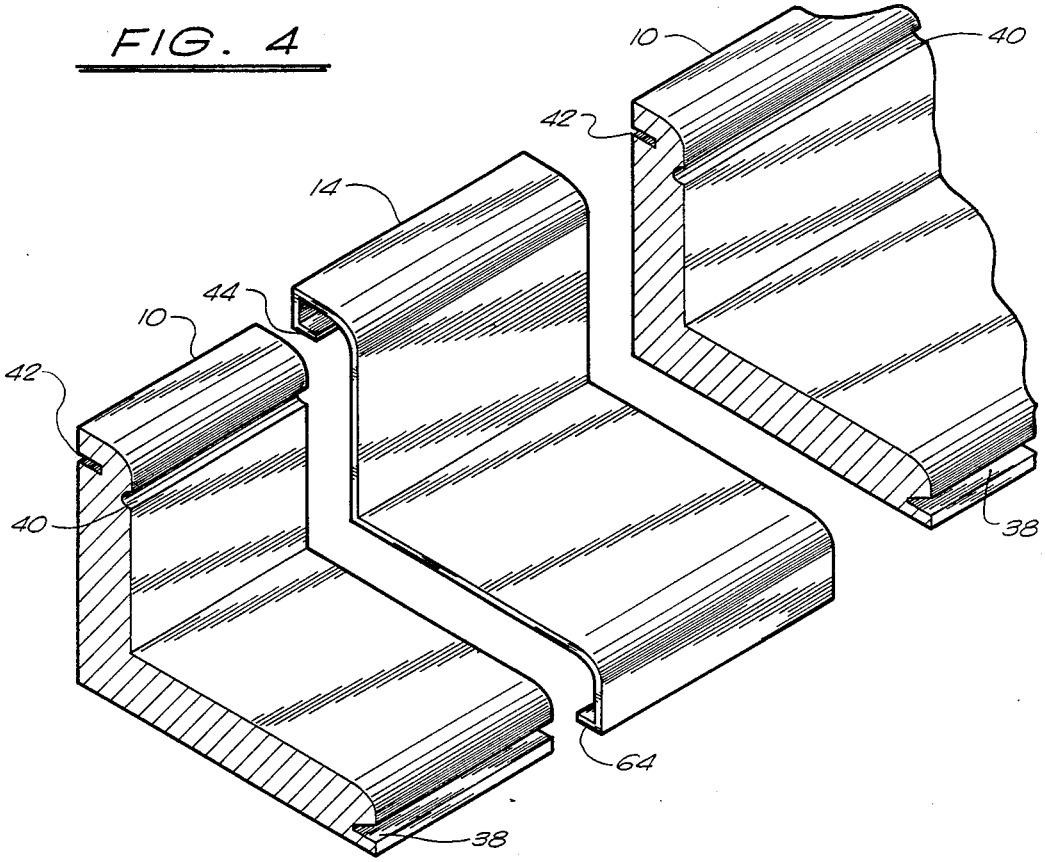
FIG. 4 is a perspective view of a type-L abutted splice cover with fence frames, normally abutted, disjoined for operational clarity.

Referring to FIG. 4, a type-L abutted splice cover 14 is illustrated. The adjoining type-L frames (10) would normally be abutted in the aproximate center of the cover. The frames are illustrated disjoined to better show how the top locking tabs (44) correspond with the longitudinal groove (42) in which the tabs snap. Both the locking tabs and the longitudinal groove are rectangular in cross-section. Also better illustrated in this disjoined position is the bottom locking tab (64). When installed, the bottom locking tab fits under the outside lower corner of the abutted frames. The cover form fits the abutment and makes an attractive splice.

Figure 5:
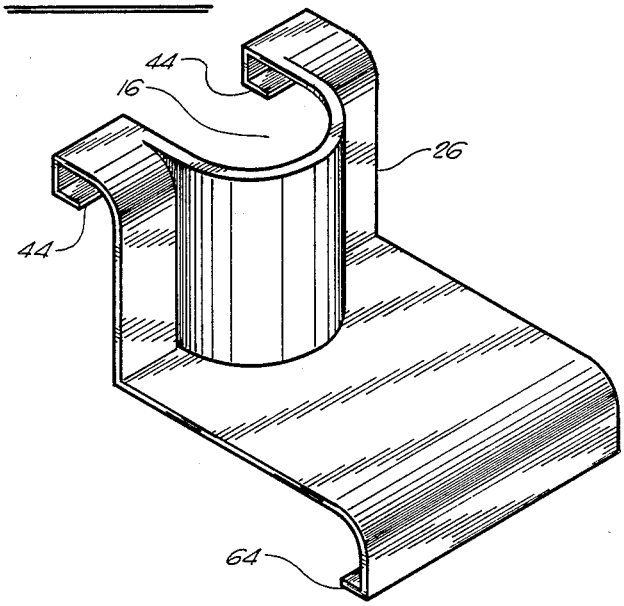
FIG. 5 is a perspective view of a type-L post splice cover.

Referring now to FIG. 5, a type-L post splice cover (26) is illustrated. Just like the splice cover of FIG. 4, the post splice cover is constructed of a thin rigid material. The post splice cover also has a base holddown tab (64) and top locking tabs (44) that lock into corresponding longitudinal groove (42). In addition, a fence post aperture (16) is provided to cover the base of the post.

Figure 6:
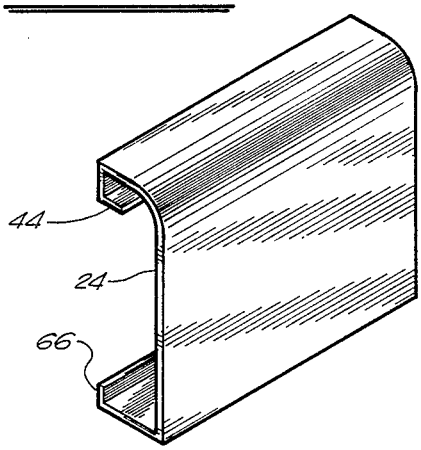
FIG. 6 is a perspective view of a type-R abutted splice cover.

Referring to FIG. 6, a type-R splice cover (24) is illustrated. This splice cover has the same top locking tab (44) as previously mentioned splice covers. It also has an additional bottom locking tab (66) that locks to the inside lower corner of a type-R frame.

Figure 7:
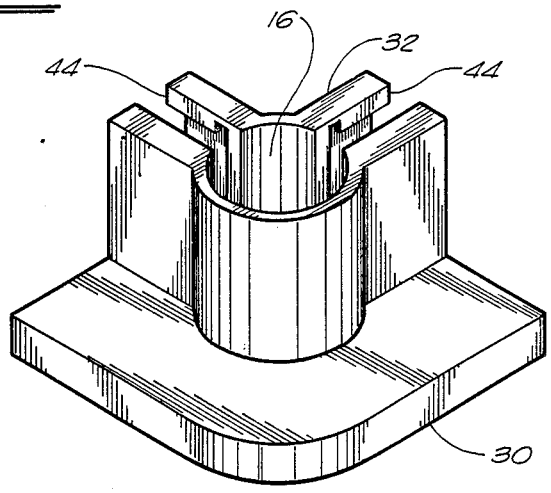
FIG. 7 is a perspective view of an inside and outside corner post splice cover.

Referring to FIG. 7, an outside corner post cover (30) is illustrated in conjunction with an inside corner post cover (32). These covers lock into post abutted frames with locking tabs (44) snapped into corresponding longitudinal grooves (42); and with bottom holddown tab under outside lower corner. A fence post aperture (16) is created when the two covers are installed on abutted inside and outside frames.

Figure 8:
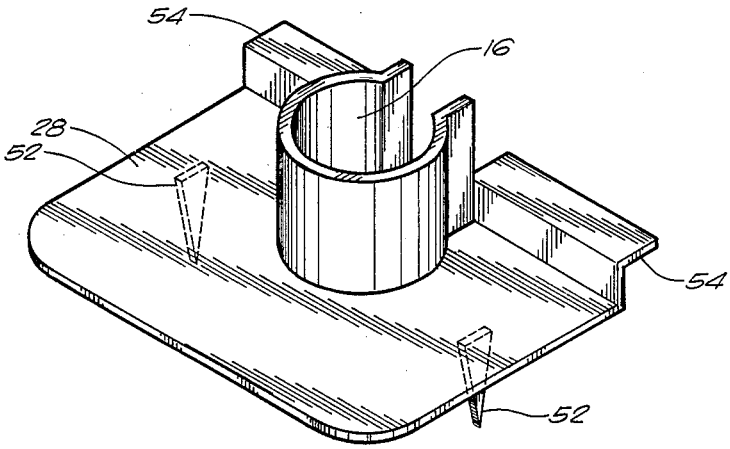
FIG. 8 is a perspective view of a gate post cover.

Referring to FIG. 8, a gate post cover (28) is shown illustrating a fence post aperture (16), two frame overlapping shields (54), and two attached ground spikes (52). The gate post cover is of a heavier guaged material than other covers previously mentioned. This greater thickness allows the installer to use sufficient pressure to force the attached ground spikes completely into the ground.

Figure 9:
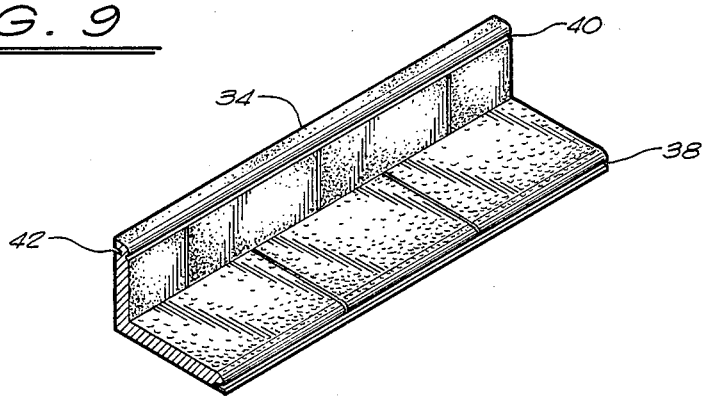
FIG. 9 is a perspective view of a type-L brick pattern FENCE FRAME.

Referring now to FIG. 9, an illustration of a brick pattern type-L frame (34) is shown. Like all fence frames, this frame is constructed with three longitudinal grooves (38, 40, 42) extending the entire length of the frame. These grooves are of the same dimension on all fence frames, thereby accepting all corresponding splice and post covers, base brackets, and spring clips.

OPERATION-FIG. 2 TO 8

In a preferred embodiment of the invention, two type-L fence frames are placed back-to-back against a chain-link fence. This is illustrated in FIG. 2. The frames on the outside of the fence are abutted to each other along the fence bottom and between the corner post (48) and, or the gate post (56). The outside frames are of a standard length, preferably greater than the span between two straight run post (36). A good average length is twelve feet. This length will locate the abutment of adjacent frames at the approximate center of the span between fence post, which are normally spaced on eight foot centers. At the point of abutment of outer frames a type-L outside splice cover (14), as illustrated in FIG. 4, is snapped into place. This is accomplished by affixing the bottom locking tab (64) under the outside corner of the base section, positioning the cover equally on the right and left of the abutted frames, overlapping top section, and pressing down until top locking tab (44) engages and conforms with the inside upper longitudinal groove (42). After splicing all outer frame abutments, inside frames should be positioned against the fence and abutted to adjoining post. These inside post abutted frames are spliced with type-L post splice covers (26) as illustrated in FIG. 5. The post abutted splice cover is installed exactly as the outside splice covers, but has an aperature void to accept a fence post. After the frames are spliced into continuous elongated vegetation barriers, both inside and outside, the base brackets (18) are installed. Installation is accomplished by placing the brackets under the fence fabric (46) and base wire (60) at regular intervals along the fence. Then position base bracket holddown tabs (50) into longitudinal V-groove (38) on either side of the fence. Next position the opposite side frame so as to receive the holdown tab in its corresponding V-groove. The second tab installation is easily completed by tilting the frame at an angle with the outside down and the inside elevated. The uniquely designed V-groove, which is actually a horizontal "V" with its lower side parallel to the ground, allows the tilted frame to receive the second holddown tab, and thereby be adjusted to fit flush with the base of the bracket. After installing a series of base brackets aproximately four feet apart, push corresponding top spring clip brackets through the diamond shaped apertures in the fence fabric and press down until top locking tabs (62) snap into corresponding top longitudinal groove (40). This groove has a semicircular cross-section, as does the corresponding locking tabs on the top spring clip bracket. The installation of the top spring clip brackets forces the back-to-back frames inward and creates a fulcrum at the inside lower corners of opposing frames. The bilateral pressure exerted against the fence fabric is compounded by this lever effect. This bilateral pressure is what secures the fence frames to the fence fabric and the ground in a stationary position. The pressure from the rigid frames straightens a fence bottom that has been bowed by the impact from a mowing device. The fence bottom is now held in line by the frames as the top is held straight by the top rail (58).

The type-R fence frame is the simplest form of the present invention, and works excellently with a monofilament type rotary grass trimmer. This frame is used when access space eliminates the use of an ordinary lawnmower or when preferred by the home owner. The type-R frame works well with a type-L frame, as illustrated in FIG. 3. Two type-R frames may be used in combination, or the type-R frame may be cut into narrow strips for holding the top and bottom brackets when only one side of the fence receives a full length barrier. The type-R frame is basically rectangular in cross-section. Although it has a different basic shape, the type-R frame installs exactly as the type-L frame. The only difference being a shorter length base bracket. The top spring clip bracket is exactly the same for both type frames. The type-R splice cover has an extra holddown tab (66), as illustrated in FIG. 6.

After the frames and splice covers are in place, all that is left is to install the gate post covers (28 FIG. 8) and corner post covers (30, 32 FIG. 7). The gate post cover slips around the post and the ground spikes are forced into the ground by applying pressure to the top of the cover with the installers foot. The corner post covers are easily installed using the same method as all other splice covers. Now that the fence is "framed", the home owner needs only to pass a lawn mower or a rotary grass trimmer along the fence base to give his yard a well landscaped appearance.

SUMMARY, RAMIFICATIONS, AND SCOPE

Accordingly, the reader can see that the fence frame is a much improved vegetation barrier embodying a far superior design of stabilization. In addition, its molded masonry patterns form a unique means of beautifying the average fence and yard. Furthermore, the frames can be assembled in a variety of ways to correspond with what ever type mowing device the owner chooses, be it a regular lawnmower or a modern monifilament type rotary trimmer.

While the above descriptions and drawings contain many details and specificities, these are used as illustrations and not to be construed as limitations. For example, the frames may be of a variety of colors to match the trim of one's home, or made in a floral or green grass pattern. In addition, the locking tabs on the stabilizing brackets could be made slightly different in shape or size to correspond with longitudinal grooves with the same cross-sectional shape.

Thus the scope of the invention should be determined by the appended claims and their legal equivalents, rather than by the preceding examples.

I claim:

1. An elongated substantially rigid vegetation barrier for eliminating vegetation adjacent to and beneath a chain-link or similar fence, said barrier comprising:

a. a horizontal base section and a vertical upper section containing a plurality of longitudinal grooves;

b. a series of base brackets in direct communication with a longitudinal groove in an outer base section of said barriers, thereby eliminating itinerancy of said barriers;

c. a series of upper external spring clip brackets corresponding with said base brackets and communicating with a longitudinal groove in an upper outer section of said barriers, thereby creating bilateral inward pressures along said barriers and against said fence, thus rendering said barriers immobile and affixed to said fence;

d. a series of barrier conforming overlapping covers to seal and splice the abutments of adjacently aligned or perpendicularly intersected said barriers.

2. The horizontal base section of claim 1 wherein is comprised of an outwardly extended section of said barrier with a longitudinal horizontally channelled V-groove embodied in outer edge of said base section extending the entire length of said barrier with height of said base section a minimal distance above top of V-groove opening, and with lower side of said groove slightly above and parallel to ground and base section.

3. The base brackets of claim 1 wherein said base brackets comprising a thin gauged substantially narrow strip of adequately rigid material formed in the shape of a flattened U, embodying inwardly extending top connected tabs parallel to the base, said tabs of a length compatible to the depth of said horizontally channelled V-groove, said base bracket of a length equal to two back to back said barriers and the fence in cross-section.

4. The vertical upper section of claim 1 wherein is comprised of an upwardly extending top section with a height that will accommodate the wheels of a lawn mower and protect adjacent fence from subsequential contact and of a width equal to the height of said outwardly extended base section, with upper outer sector of said vertical section embodying a semicircular longitudinal groove, said groove extending the entire length of said barrier; said upper section being molded and formed together with said base section, thereby being L-shaped in crossection.

5. The upper external spring clip bracket of claim 1 wherein said bracket being of a generally cresent shaped strip of rigid springable material with two diametrically opposed locking tabs of the exact shape and diameter as the longitudinal groove of the upper outer section of the barrier said tabs formed on each cresent extremity, with said bracket being of a width narrow enough to transverse the diamond shaped aperatures in the weave of the fence fabric and of a length between the opposing locking tabs equal to the distance between the inside of said longitudinal groove on back to back said barriers and the fence fabric in cross-section.

6. A barrier overlapping cover of claim 1 wherein said covers are of a thin gauged material of comparable composition and rigidity as said barriers, and of a width adequate to overlap abutted frames, said covers are of a form that duplicates the shape of outer exterier of said barriers, extend beneath lower outside corner of said barriers forming a lower holddown tab, overlap upper inside corner, and terminate lockingly in longitudinal groove in upper inside sector of said barriers forming a top locking tab, said groove extends the entire length of said barriers and is of the same cross-sectional shape and dimensions as said top locking tab.

7. A barrier overlapping cover of claim 1 wherein said cover circumvents and conforms with the base of a fence gate post, said cover comprising two shields that rest atop and overlap lower horizontal sections of two back to back said barriers abutted to said gate post, and two molded ground spikes attached to the base of said cover.

8. An elongated substantially rigid vegetation barrier for eleminating vegetation adjacent to and beneath a chain-link or similar type fence, said barrier being of a vertical rectangle in cross-section and comprising:

a. a plurality of longitudinal grooves extending the entire length of said barriers;

b. a series of base brackets in direct communication with the longitudinal groove in a lower outside section of said barrier;

c. a series of upper external spring clip brackets corresponding with said base brackets and communicating with longitudinal groove in an upper outer section of said barriers, thereby creating bilateral inward pressures along said barriers and against said fence, thus stabilizing and affixing said barriers to said fence;

d. a series of barrier conforming overlapping covers to seal and splice the abutments of adjacently aligned or perpendicularly intersected barriers.

9. The vegetation barrier of claim 8 wherein said barrier embodies an inwardly channelled horizontal V-groove in the lower outside section of said barrier, said groove extending the entire length of said barrier with lower side of said groove slightly above and parallel to ground and base section.

10. The base brackets of claim 8 wherein said brackets are the shape of a flattened U, embodying two inwardly extending tabs connected to tops of said bracket and parallel to base and ground, said tabs of a length slightly less than the lower side of said V-groove of the outer base section of the barrier.

11. The upper outer section of the barrier of claim 8 embodying a semicircular longitudinal groove, said groove extending the entire length of said barrier.

12. The upper external spring clip brackets of claim 8 wherein is comprised of a basically cresent shaped strip of rigid springable material embodying two diametrically opposed locking tabs of the exact diameter as said longitudinal groove of the upper outer section of the barrier, said tabs formed on each crescent extremity; said spring clip bracket being of a width narrow enough to transverse the diamond shaped aperatures in the weave of the fence fabric, and of a length between opposing locking tabs equal to the distance between the inside of longitudinal grooves of the upper outer section of the barrier on back to back barriers of claim 8 and the fence fabric in cross-section.

13. The barrier overlapping covers of claim 8 wherein said covers are of a thin gauged material of comparable composition and rigidity as said barriers, and of a width adaquate to overlap abutted said barriers; said covers are of a form that duplicates the shape of outer exterior of said barriers, extend beneath base of said barriers, and protrude vertically slightly from the lower inside corner, forming a bottom locking tab, overlap upper inside corner, and terminate lockingly in the longitudinal groove embodied in upper inside section of said barriers forming a top locking tab, said groove extends the entire length of said barrier and is of the same cross-sectional shape and dimensions as said top locking tab.

* * * * *